US012377889B2

(12) United States Patent
Heinzl

(10) Patent No.: US 12,377,889 B2
(45) Date of Patent: Aug. 5, 2025

(54) ENERGY DISSIPATION DEVICE

(71) Applicant: Siemens Mobility Austria GmbH, Vienna (AT)

(72) Inventor: Philipp Heinzl, Enzenreith (AT)

(73) Assignee: Siemens Mobility Austria GmbH, Vienna (AT)

( * ) Notice: Subject to any disclaimer, the term of this patent is extended or adjusted under 35 U.S.C. 154(b) by 919 days.

(21) Appl. No.: 17/612,382

(22) PCT Filed: May 18, 2020

(86) PCT No.: PCT/EP2020/063857
§ 371 (c)(1),
(2) Date: Nov. 18, 2021

(87) PCT Pub. No.: WO2020/234252
PCT Pub. Date: Nov. 26, 2020

(65) Prior Publication Data

US 2022/0250661 A1 Aug. 11, 2022

(30) Foreign Application Priority Data

May 20, 2019 (AT) ..... A 50462/2019

(51) Int. Cl.
*B61G 11/16* (2006.01)

(52) U.S. Cl.
CPC ..... *B61G 11/16* (2013.01)

(58) Field of Classification Search
CPC ..... B61G 11/00; B61G 11/02; B61G 11/08; B61G 11/14; B61G 11/16
See application file for complete search history.

(56) References Cited

U.S. PATENT DOCUMENTS

| | | | |
|---|---|---|---|
| 8,225,722 | B2 | 7/2012 | Graf et al. |
| 2005/0046207 | A1 | 3/2005 | Rossmann |
| 2010/0218701 | A1 | 9/2010 | Graf et al. |
| 2012/0139273 | A1 | 6/2012 | Jeong et al. |
| 2013/0105431 | A1 | 5/2013 | Hansson et al. |
| 2018/0029549 | A1 | 2/2018 | Palo |

FOREIGN PATENT DOCUMENTS

| | | | |
|---|---|---|---|
| DE | 446174 | 6/1927 | |
| EP | 1506895 | 2/2005 | |
| WO | 2004083526 | 9/2004 | |
| WO | 2009040309 | 4/2009 | |
| WO | 2013014628 | 1/2013 | |
| WO | WO-2013014628 A1 * | 1/2013 | ..... B61D 15/06 |

* cited by examiner

*Primary Examiner* — Robert J McCarry, Jr.
(74) *Attorney, Agent, or Firm* — Cozen O'Connor

(57) ABSTRACT

An energy dissipation device for a rail vehicle, includes a baffle plate that is configured to absorb and transfer impacting collision forces, a rear plate that is configured to fasten the energy dissipation device to a vehicle structure and at least two buckling plates arranged between the baffle plate and the rear plate, where the at least two buckling plates are provided with a pre-deformation in the direction of a desired deformation direction, and the at least two buckling plates are connected to one another by pull-push structure.

9 Claims, 3 Drawing Sheets

ENERGY DISSIPATION DEVICE

CROSS-REFERENCE TO RELATED APPLICATIONS

This is a U.S. national stage of application No. PCT/EP2020/063857 filed 18 May 2020. Priority is claimed on Austrian Application No. A50462/2019 filed 20 May 2019, the content of which is incorporated herein by reference in its entirety.

BACKGROUND OF THE INVENTION

1. Field of the Invention

The invention relates to an energy absorbing device for a rail vehicle.

2. Description of the Related Art

In order to improve passive safety in the event of a collision, rail vehicles, in particular passenger rail vehicles, are equipped with defined crumple zones, in which kinetic energy is converted into deformation energy and/or heat energy. This makes it possible to reduce loads on the people in the vehicle. For this purpose, it is possible, on the one hand, to configure large surface areas of the rail vehicle structure in the front region such that they can absorb the deformation energy in a targeted manner or special crash modules are placed onto the front and rear structure of the rail vehicle. The special crash modules are advantageous because repair after a collision is facilitated by the easy accessibility of these crash modules. These crash modules are also referred to as energy absorbing devices, deformation modules, deformation elements, crumple elements or energy absorbing elements. The direction of the acting deformation force is decisive for the correct function, i.e., an exhaustion of the energy absorbing capacity of an energy absorbing device that is as complete as possible. If this acting deformation force does not occur in the intended direction, for example, obliquely or not at the intended force application point, then there is a tendency for crash modules, especially ones that are attached at the end of the vehicle, to deform only on one side. The result of this is that the free end of the crash module in question, which is usually provided with a climbing protection device, tilts, significant transverse forces are generated, the capacity of the crash module to absorb energy can no longer be completely exhausted, and moreover the other parties involved in the crash are at risk because the now oblique contact points can slide onto one another.

SUMMARY OF THE INVENTION

In view of the foregoing, it is therefore an object of the invention to provide an energy absorbing device which, even when there is a parallel displacement of the acting collision force, such as when two rail vehicles that impact one another are laterally offset, not only deforms on one side, but the deformation is introduced in a manner distributed uniformly over the entire periphery of the energy absorbing device and thus, in the further course of the crash, can exhaust its capacity for absorbing energy.

This and other objects and advantages are achieved in accordance with the invention by an energy absorbing device for a rail vehicle, which comprises an impact plate that is configured to absorb and transfer applied collision forces, a back plate that is configured to fasten the energy absorbing device to a vehicle structure, and at least two buckle plates arranged between the impact plate and the back plate, where the buckle plates are provided with a preliminary deformation in a desired deformation direction, and where the buckle plates are connected to one another by a tension/compression structure.

This makes it possible to obtain the advantage that, when a deformation force is being applied to the energy absorbing device outside an intended force direction, a partial collapse, in particular a collapse on one side, of the energy absorbing device can be avoided. If deformation occurs on one side, then the tension/compression structure transfers the deformation of the one buckle plate to the respective other buckle plate and deforms it, such that the impact plate undergoes parallel displacement in relation to the back plate.

An energy absorbing device in accordance with the invention comprises a back plate that is configured to fasten the energy absorbing device to a vehicle structure. This fastening may preferably be configured as detachable via screw connections. For specific intended uses, a non-detachable connection is also advantageous. The non-detachable connection is advantageous particularly if the energy absorbing device is dimensioned such that triggering it leads to further damage to the vehicle structure in any case and repair of the vehicle is no longer economically expedient.

An impact plate for absorbing collision forces introduced by another party involved in the collision is provided spaced apart from and parallel to the back plate. This impact plate should have a massive configuration such that, while the collision is occurring, even when the other parties involved in the collision are massive, such as in the case of the locomotive front faces used in the USA, it remains able to transfer the introduced forces as homogeneously and as really as possible to the energy absorbing device located behind it. Here, the impact plate can be configured either in one piece as a cast steel part or in the form of a welded construction of steel plates having internal honeycomb reinforcements.

At least two buckle plates are arranged between the impact plate and the back plate and are connected to the impact plate or back plate. These buckle plates are configured as plate-shaped components and are aligned vertically in the installed position of the energy absorbing device. They are equipped with a preliminary deformation, with the result that they deform in a predetermined way when a deformation force introduced via the impact plate is acting. In this regard, it is particularly advantageous to configure the buckle plates as plates with a single bending point, with the result that the buckle plates have a V-shaped profile. The deformation direction of the buckle plates is thus clearly predefined. It is essential that the preliminary deformations of the buckle plates point in the same direction, because only in this way is it ensured that the deformation of a buckle plate can also be transferred to the further buckle plates and a deformation of these further buckle plates is induced.

The buckle plates are connected to one another by means of a tension/compression structure. A tension/compression structure transfers both tensile and compressive forces without itself deforming in a noteworthy manner in the process. For this purpose, for example, sufficiently thick, rod-shaped components may be used, which also do not buckle under compressive loading. In particular, it is advantageous to use a plate-shaped component, a synchronization plate, as the tension/compression structure. This synchronization plate extends between the buckle plates and is connected fixedly to the buckle plates. The synchronization plate is oriented parallel to the back plate and the impact plate here. It is particularly advantageous to provide the points at which the synchronization plate is connected to the buckle plates at the position of greatest preliminary deformation of the buckle plates, because this makes it possible to achieve the greatest possible deformation of the further buckle plates.

In a further embodiment the invention, it is advantageous to provide at least one shear-stiff connection plate (support plate) between the back plate and the impact plate, where the shear-stiff connection plate prevents a displacement of the impact plate parallel to the back plate. This support plate should be configured as a plate-shaped component and in each case should be connected fixedly to the impact plate and the back plate. Here, the support plate can be arranged at the top or the bottom boundary of the energy absorbing device. A preferred embodiment of the invention provides the arrangement of two support plates, one at the top and one at the bottom, with the result that a complete sheathing of the energy absorbing device can be achieved with additional lateral coverings. The energy absorbing device is thus better protected against dirt or corrosion.

The energy absorbing device in accordance with the embodiments of the invention forms a substantially hollow, cuboidal assembly, and therefore it is expedient in accordance with the further embodiment of the invention to fill this cavity at least partially with further energy absorbing elements. This makes it possible to further increase the capacity of the energy absorbing device to absorb energy.

IN a preferred embodiment of the invention, energy absorbing elements are arranged between the back plate and the impact plate and they are guided through apertures in the tension/compression means (synchronization plate). Here, the energy absorbing elements may be connected either to the impact plate or to the back plate and the apertures in the synchronization plate have to ensure that the synchronization plate can move sufficiently without collision.

In a further embodiment of the invention, further energy absorbing elements are arranged on the tension/compression structure (synchronization plate) itself. Here, a front and a rear energy absorbing element are fastened to the synchronization plate. The front energy absorbing element extends between the synchronization plate and the impact plate but does not touch them, rather being spaced apart from the impact plate to a certain extent. The rear energy absorbing element extends between the synchronization plate and the back plate but does not touch them, rather being spaced apart from the back plate to a certain extent. The movability of the synchronization plate at the start of the deformation operation is thus not restricted, and the synchronization plate can therefore transfer the deformation of one buckle plate to the further buckle plates and the spacings between the rear and front energy absorbing elements and the back plate or impact plate are closed as the deformation continues and the rear and front energy absorbing elements start to act. From this point in time at which the deformation occurs, although the movability of the synchronization plate is impeded, the displaceability of the synchronization plate is now also no longer necessary to the full extent.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE EXEMPLARY EMBODIMENTS

Figure 1:
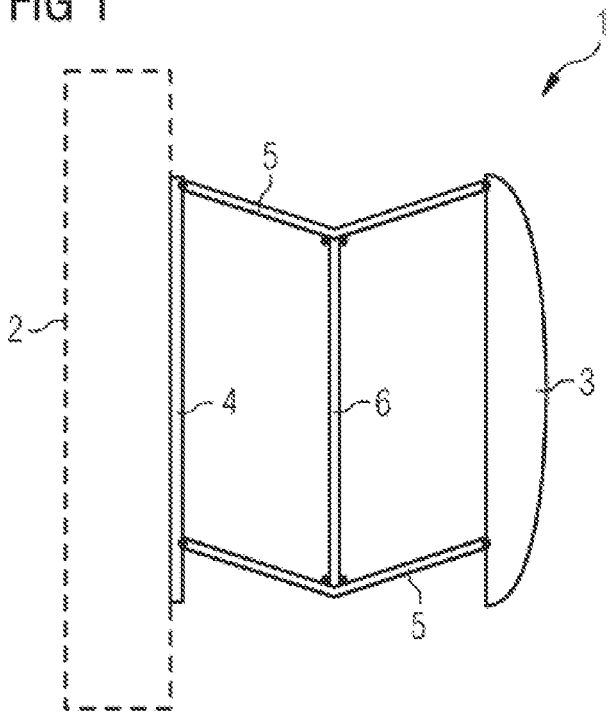
FIG. 1 shows an energy absorbing device in accordance with the invention.

FIG. 1 shows an energy absorbing device by way of example and schematically. What is illustrated is a view from above of an energy absorbing device 1 in the installed position. Here, the energy absorbing device 1 is mounted via a back plate 4 on a vehicle structure 2 of a rail vehicle. In addition to the back plate 4, the energy absorbing device 1 comprises an impact plate 3, which is arranged on the side facing another party involved in the collision. In the exemplary illustrated embodiment, two buckle plates 5 are arranged between the back plate 4 and the impact plate 3, each of which is welded to the back plate 4 and impact plate 3. The buckle plates 5 have a preliminary deformation formed as a bend, where the bends of both buckle plates 5 point in the same direction. The buckle plates 5 are connected via a tension/compression structure 6. In the exemplary illustrated embodiment, the tension/compression structure 6 is formed as a plate-shaped component (synchronization plate) and is welded to the buckle plates 5 at the point of greatest deformation.

Figure 2:
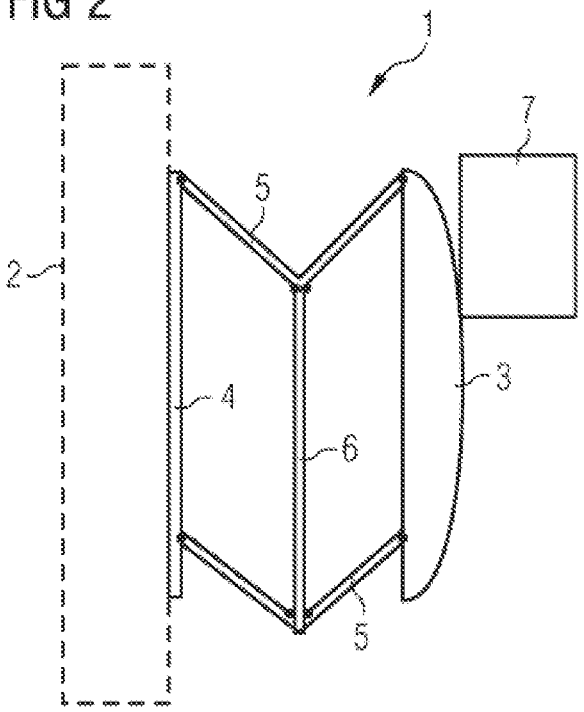
FIG. 2 shows the energy absorbing device of FIG. 1 during deformation.

FIG. 2 shows an exemplary schematic illustration of an energy absorbing device during the deformation. What is illustrated here is the energy absorbing device 1 under the action of another party 7 involved in the collision. Here, the other party 7 involved in the collision strikes the impact plate 3 off-center, which would accordingly lead to this device collapsing on one side in the case of conventional energy absorbing devices. A partially continued deformation is illustrated, in which a part of the energy absorbing device is already exhausted. In this case, the tension/compression structure 6 brings about a symmetrical deformation of the two buckle plates 5 and thus a displacement of the impact plate 3 parallel to the back plate 4. The energy absorbing device 1 shown in FIGS. 1 and 2 has only the buckle plates 5 as energy absorbing components, in the case of which the collision energy is converted into deformation energy. Further energy absorbing components are not included in order to simplify this basic illustration.

Figure 3:
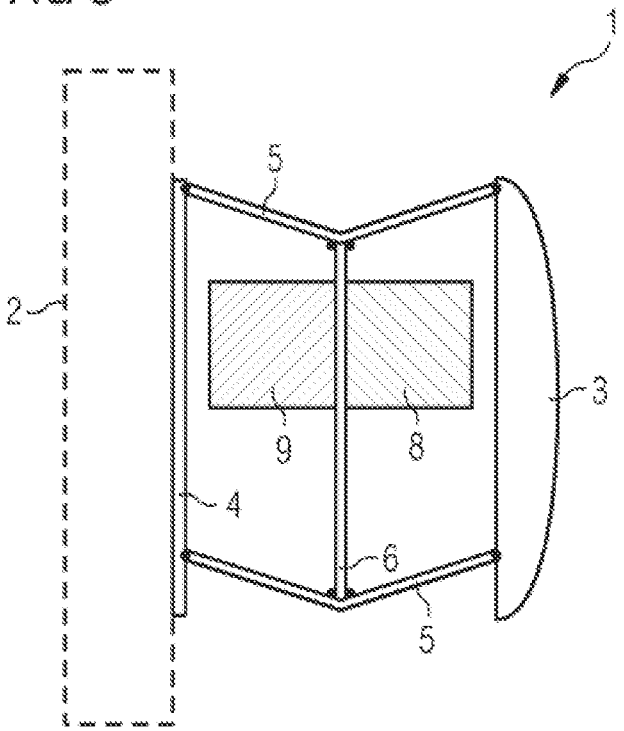
FIG. 3 shows the energy absorbing device with energy absorbing elements in accordance with the invention.

FIG. 3 shows an exemplary schematic illustration of energy absorbing device with energy absorbing elements. What is illustrated here is an energy absorbing device 1, which corresponds substantially to those of FIGS. 1 and 2, but is additionally equipped with a front energy absorbing element 8 and a rear energy absorbing element 9. Here, the energy absorbing elements 8, 9 are arranged on the tension/ compression structure 6. A front energy absorbing element 8 extends in the direction of the inner side of the impact plate 3; there is a free space between the front energy absorbing element 8 and this inner side of the impact plate 3. The rear energy absorbing element 9 is similarly spaced apart from the back plate 4. Consequently, in the event of a collision, it is ensured that the tension/compression structure 6 can move freely until the deformation has continued far enough such that the described spacings are closed.

Figure 4:
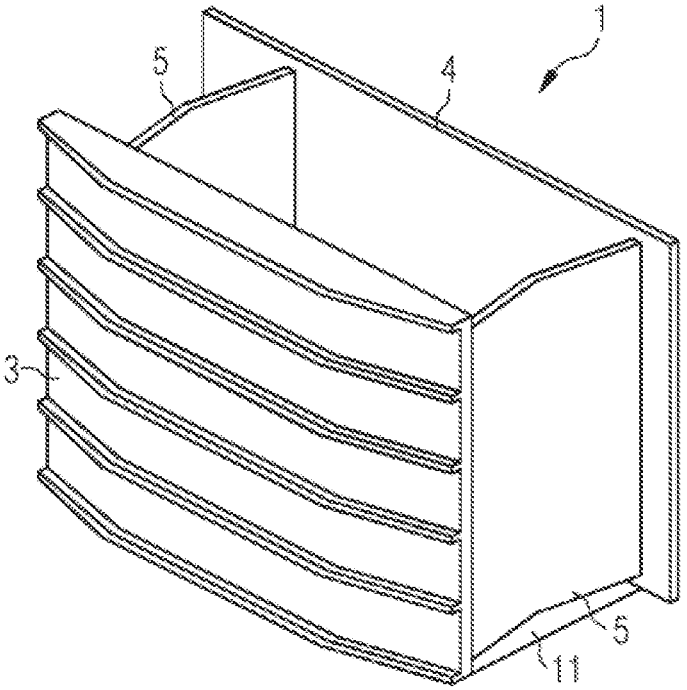
FIG. 4 shows an oblique view of the energy absorbing device in accordance with the invention.

FIG. 4 shows an exemplary schematic oblique view of an energy absorbing device. What is illustrated here is an energy absorbing device 1 that has a similar construction to those of FIGS. 1 and 2, but additionally comprises a support plate 11. In the exemplary illustrated embodiment, the impact plate 3 is equipped with a horizontal toothed structure as a climbing protection device. The tension/compression structure 6 is concealed by the adjacent components and cannot be seen. A support plate 11 is arranged on the lower boundary of the energy absorbing device 1 and connects the impact plate 3 to the back plate 4.

Figure 5:
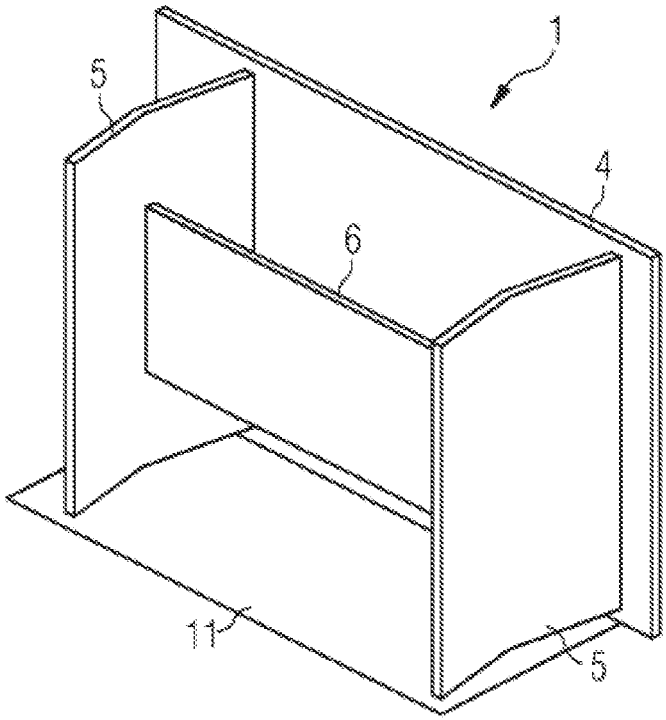
FIG. 5 shows the energy absorbing device of FIG. 1 without an impact plate.

FIG. 5 shows an exemplary schematic illustration of an energy absorbing device without an impact plate. What is illustrated here is the energy absorbing device 1 of FIG. 4 with the impact plate 3 removed. Here, the tension/compression structure 6, which is formed as a plate-shaped component (synchronization plate), can be seen. The tension/compression structure 6 extends vertically only over part of the overall height of the energy absorbing device 1; respective top and bottom free regions, in which energy absorbing elements can be arranged, remain. A further support plate 11 on the top boundary of the energy absorbing device 1 is similarly possible, which would enhance the stabilizing effect of the support plate 11.

Figure 6:
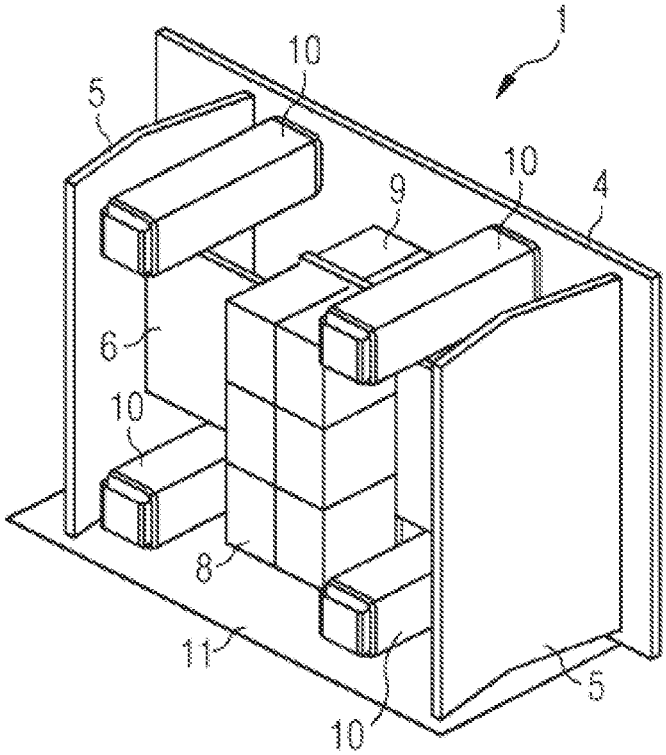
FIG. 6 shows the energy absorbing device of FIG. 1 with energy absorbing elements.

FIG. 6 shows an exemplary schematic illustration of an energy absorbing device with energy absorbing elements. What is illustrated here is an oblique view of an energy absorbing device 1 with the impact plate 3 removed. Four energy absorbing elements 10 are arranged on the back plate 4. These energy absorbing elements 10 extend to right in front of the back side of the impact plate 3. The energy absorbing device 1 is furthermore equipped with front 8 and rear 9 energy absorbing elements, which are fastened to the tension/compression structure 6 in the form of a synchronization plate and each of which is spaced apart from the back plate 4 or the impact plate 3.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An energy absorbing device for a rail vehicle, comprising:

an impact plate which is configured to absorb and transfer applied collision forces;

a back plate configured to fasten the energy absorbing device to a vehicle structure; and at least two vertical buckle plates arranged between the impact plate and the back plate;

wherein the at least two buckle plates include a preliminary vertical deformation in a desired deformation direction; and wherein the at least two buckle plates are interconnected via a tension/compression structure.

2. The energy absorbing device as claimed in claim 1, wherein the at least two buckle plates are arranged vertically in an installed position of the energy absorbing device and the desired deformation directions of the at least two buckle plates point in the same direction.

3. The energy absorbing device as claimed in claim 2, wherein the tension/compression structure comprises a synchronization plate formed.

4. The energy absorbing device as claimed in claim 2, further comprising:

at least one energy absorbing element arranged between the back plate and the impact plate, at least one energy absorbing element being guided through an aperture in the tension/compression structure.

5. The energy absorbing device as claimed in claim 1, wherein the tension/compression structure comprises a synchronization plate formed.

6. The energy absorbing device as claimed in claim 5, further comprising:

at least one energy absorbing element arranged between the back plate and the impact plate, at least one energy absorbing element being guided through an aperture in the tension/compression structure.

7. The energy absorbing device as claimed in claim 1, further comprising:

at least one energy absorbing element arranged between the back plate and the impact plate, at least one energy absorbing element being guided through an aperture in the tension/compression structure.

8. The energy absorbing device as claimed in claim 1, further comprising:

a front energy absorbing element fastened to the tension/compression means, said front energy absorbing element extending between the tension/compression structure and the impact plate and being spaced apart from the impact plate; and a rear energy absorbing element fastened to the tension/compression structure, said rear energy absorbing element extending between the tension/compression structure and the back plate and being spaced apart from the back plate.

9. The energy absorbing device as claimed in claim 1, further comprising:

at least one support plate disposed between the back plate and the impact plate, each of which is connected fixedly to the impact plate and the back plate.

* * * * *